US005647555A

United States Patent [19]

Conrad et al.

[11] Patent Number: 5,647,555

[45] Date of Patent: Jul. 15, 1997

[54] WINDING ROLLER SUPPORT DEVICE FOR WEB MATERIAL

[75] Inventors: Hans-Rolf Conrad, Dormagen; Dieter Junk, Kreuztal, both of Germany

[73] Assignee: Voith Sulzer Finishing GmbH, Krefeld, Germany

[21] Appl. No.: 504,931

[22] Filed: Jul. 20, 1995

[30] Foreign Application Priority Data

Aug. 6, 1994 [DE] Germany ..... 44 27 877.2

[51] Int. Cl.[6] ..... B65H 18/26

[52] U.S. Cl. ..... 242/547; 242/908

[58] Field of Search ..... 242/547, 541.5, 242/541.4, 541.6, 541.7, 908

[56] References Cited

U.S. PATENT DOCUMENTS

| | | | |
|---|---|---|---|
| 3,497,151 | 2/1970 | Voss et al. | 242/541.7 |
| 3,515,183 | 6/1970 | Voss | 242/908 X |
| 3,920,136 | 11/1975 | Talbert | 242/908 X |
| 5,106,029 | 4/1992 | Ehrola | 242/541.7 |
| 5,150,850 | 9/1992 | Adams | 242/541.5 X |

FOREIGN PATENT DOCUMENTS

| | | | |
|---|---|---|---|
| 36 39 244 | 5/1987 | Germany . | |
| 3 729 448 | 3/1989 | Germany | 242/908 |
| 40 26 597 | 2/1992 | Germany . | |
| 42 01 815 | 7/1993 | Germany . | |

*Primary Examiner*—Daniel P. Stodola
*Assistant Examiner*—William A. Rivera
*Attorney, Agent, or Firm*—Darby & Darby

[57] ABSTRACT

A winding device for supporting a winding roller for web material, in particular, for paper, has a supporting arrangement which works from underneath in opposition to a deflection of the winding roller and which creates a compressed air cushion between the supporting arrangement and the winding roller. The air cushion is created by means of an over-pressure in a space between the support rollers that are placed underneath the winding roller. However, due to the changing winding radius, the sealing at the ends of the winding space is difficult to maintain. In order to achieve a support of the winding roller that is free of support rollers and that smooths the web material, it is now provided that the supporting arrangement has at least one support plate with an upper side which is substantially matched to the contour of the under side of the winding roller and in which there is configured at least one compressed air outlet opening, that the compressed air can exit through a gap between the winding roller and the support plate, and that the support plate can automatically adjust itself radially to the winding roller in accordance with the winding diameter.

6 Claims, 3 Drawing Sheets

WINDING ROLLER SUPPORT DEVICE FOR WEB MATERIAL

FIELD OF THE INVENTION

This invention relates generally to a winding device capable of supporting a winding roller for web material, and more particularly, for paper, with a supporting arrangement which works from underneath the winding roller in opposition to a deflection of the winding roller and which creates a compressed air cushion between the supporting arrangement and the winding roller.

BACKGROUND OF THE INVENTION

During the winding and unwinding of a web material, paper in particular, problems can arise as a result of the deflection of the winding roller depending upon the relationship of the winding mass, web width, physical properties of the winding layers (for example, the winding hardness, extension, compression, and frictional behavior of the paper), the stiffness and the bearing spacing of the winding shaft and of the reel spool.

Problems can also arise, especially when a contact or feed roller is being used, which is pressed substantially horizontally against the winding (i.e. roll) on the winding roller. The differing deflections of the feed roller and the winding roller which result, lead to a non-uniform contact pressure curve across the width of the web. This further results in folds and breaks which occur along the edges of the winding.

From German unexamined laid open patent application DE 36 39 244 A1, it is known that a differential deflection can be compensated for by means of a complete or partial lifting of the weight of the roller by means of supporting belts.

In the case of the winding device described above and known from German unexamined laid open patent application DE 40 26 597 A1, there is created an over-pressure that forms an air cushion in the space between the winding roller and the support rollers, wherein the support rollers are placed parallel to the axis of the winding roller.

However, both prior art devices do not go easy on the winding surface, since both the support rollers as well as the supporting belt exert a mechanical influence on the web being processed, and specifically, at the winding device with the air cushion space, as the sealing at the two axial ends of the air cushion space is difficult to maintain because of the changing winding radius which, for example, can increase from 500 mm to 3000 mm.

From German unexamined laid open patent application DE 42 01 815 A1 (FIG. 7), it is known that underneath the winding roller and extending throughout its length, a compression chamber is positioned which is open at the top and acted upon by compressed air, and which is vertically adjustable and can be swiveled. The compression chamber is provided at its front upper edge with sealing strips adaptable to the curvature of the winding roller by means of adjusting elements placed inside the compression chamber, and at its one longitudinal upper edge also with a sealing strip, and at the other longitudinal upper edge with a spacer roller that extends along this upper edge. The sealing strips are held at a distance from the winding roller, the distance corresponding to a desired air gap, by means of a spacer roller that lies against the winding roller during the swiveling of the compression chamber against the winding roller, in order to prevent any friction between the winding roller and the sealing strips. Referring to FIG. 8, an additional spacer roller is supported along the other longitudinal upper edge of the compression chamber. This system has significant disadvantages due to its numerous components. For example, such an arrangement is expensive and does not operate in a non-contacting manner which could damage the web.

SUMMARY OF THE INVENTION

Accordingly, it is an object of the present invention to provide an improved winding device for supporting the winding roller which is within the width of the web and which reliably goes easy on the web.

It is a further object of the present invention that the supporting arrangement has at least one support plate with an upper side which is substantially matched to the contour of the under side of the winding roller and in which there is configured at least one compressed air outlet opening, that the compressed air can exit through a gap between the winding roller and the support plate, and that the support plate can automatically adjust itself radially to the winding roller in accordance with the winding diameter, and thus adapt itself to the winding roller contour.

The support plate can be configured so that it can bend elastically. As a result, the support plate can extend over a relatively large angle of wrap of the winding roller, and can thus easily bend under the force of servomotors, which engage in the vicinity of its edges that extend parallel to the axis of the winding roller, and against the force of the compressed air such that the radius of curvature of its upper side is substantially matched to the current radius of curvature of the winding or the roll on the winding roller.

However, it is also possible for the support plate to have on its under side, in the vicinity of each of its axial longitudinal edges, one projection each which protrudes downward, and a servomotor which is secured in an articulated manner between the ends of the projections and by means of which there can be exerted on each of the ends a force which causes a bending of the support plate such that the radius of curvature of its upper side corresponds to the current radius of the winding on the winding roller.

DETAILED DESCRIPTION OF THE INVENTION

Figure 1A:
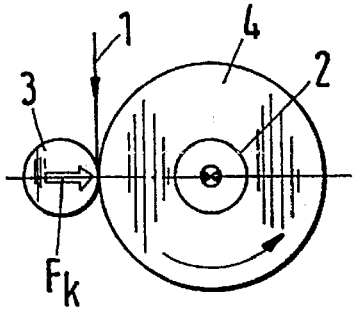
Fig. 1A (PRIOR ART)
FIGS. 1A and 1B are a side and front view of a conventional winding device.
Figure 1B:
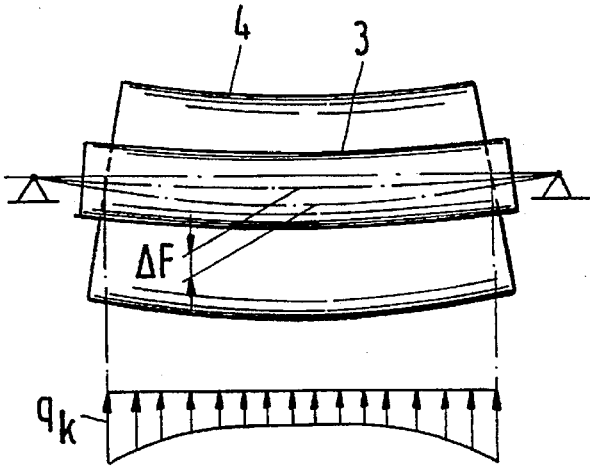
Fig. 1B (PRIOR ART)

Referring to FIG. 1, a conventional winding device is shown having a web 1, such as a web of paper, wound onto a winding roller 2. The web 1 is pressed against the winding roller 2, or more specifically, against the winding (i.e. the roll) 4 with a force $F_k$ by means of a contact or feed roller 3. With the increasing diameter and correspondingly increasing weight of the winding 4 and the winding roller 2, the winding 4 will deflect more severely, as a result of which the differing deflection differentials ΔF between the contact roller 3 and the winding roller 2 or the winding 4 lead to a non-uniform contact pressure curve $q_k$ over the width of the web, with the further result that crepe folds and breaks occur along the edges of the winding 4.

Figure 2:
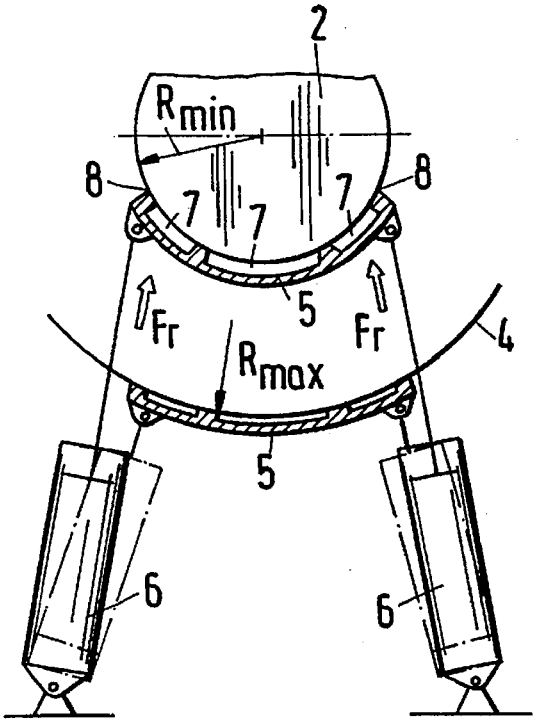
FIG. 2 is a cross-sectional view of the preferred winding device according to the present invention.

Referring to FIG. 2, a supporting arrangement 5, 6 is provided with a flexible support plate 5 and pneumatic or hydraulic servomotors 6 in the form of piston-cylinder arrangements. The support plate 5 has an upper side which is substantially matched to the contour of the under side of the winding roller 2, and in which there are configured three compressed air outlet openings 7, to which compressed air is directed, from a compressed air source (not shown), through the support plate 5. The compressed air can exit through the gap 8 between the winding roller 2 and the support plate 5, and acts against a force $F_r$ of the servomotors 6, which acts on the support plate 5 near the longitudinal edges of the support plate 5 that are parallel to the winding roller 2. The compressed air forms an air cushion in the gap 8 between the support plate 5 and the winding roller 2, in conjunction with which the upper side of the support plate 5, due to the flexibility of the support plate 5, substantially adapts itself to the contour of the winding 4. The diameter of the winding 4 increases from the smallest winding radius $R_{min}$, which corresponds to the radius of the winding roller 2, to the largest radius of curvature $R_{max}$ of the winding 4. In addition, synchronously with the increase of the diameter of the winding 4, the support plate 5 is moved downward by means of the servomotors 6, as shown in FIG. 2 by the lower position of the support plate 5.

Figure 3:
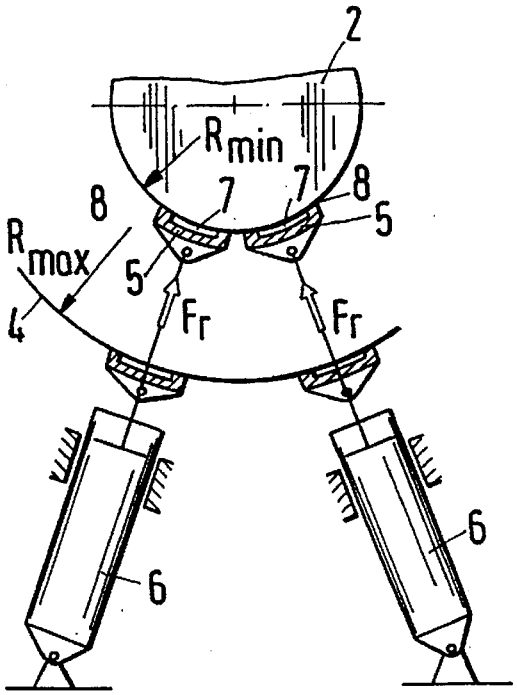
FIG. 3 is a cross-sectional view of an alternate winding device according to the present invention.

Referring to FIG. 3, in an alternate embodiment, only two support plates 5 are provided, each of which has one compressed air outlet opening 7 and in which the radius of curvature of the upper side of the support plate 5 is matched to an average radius of curvature $R_{average}$ of the winding 4. Each support plate 5 is individually acted upon with a force $F_r$ by one of the two servomotors 6, these forces $F_r$, in contrast to that of the forces $F_r$ of FIG. 2, being exerted in the center of the support plate 5 in question and directed radially to the center line of the winding roller 2.

In both embodiments of FIGS. 2 and 3, the servomotors 6 are hinged to the support plate 5 by their pistons rods on one end, and to a fixed stand on the other. In addition, the winding radius acts as a reference variable input for the adjustment of the support plate(s) 5 by the servomotors 6 in a position control system. In both embodiments, however, the gap 8, which is preferably concentric with each winding radius, may have small deviations from an exact concentricity.

Figure 4:
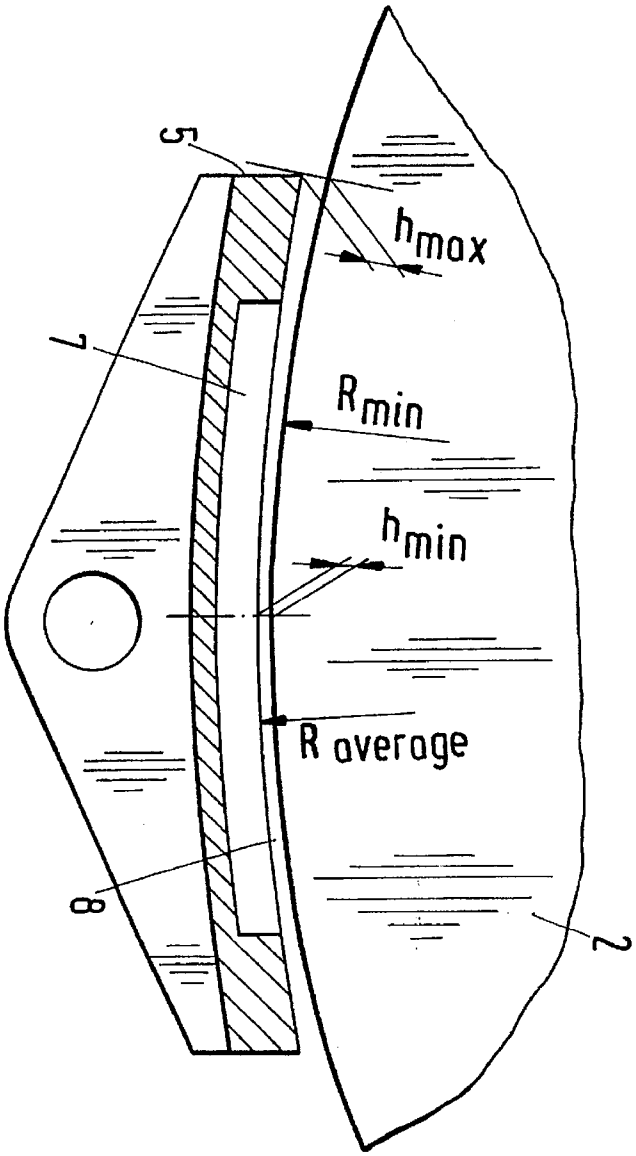
FIGS. 4 and 5 are sectional views of the winding device of FIG. 3 in the unwound state of the winding roller (FIG. 4) and in the completely wound state of the winding roller (FIG. 5).
Figure 5:
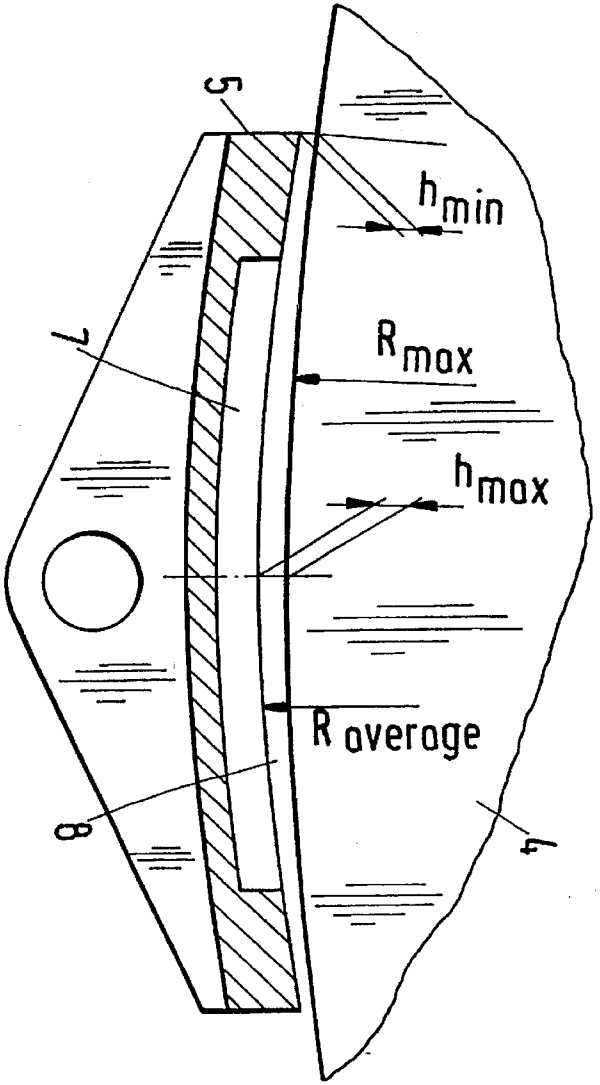

In the embodiment of FIG. 2, it may be difficult to bend the support plate 5 into an exact arc. However, in the embodiment of FIG. 3, the gap 8 is adjusted depending on the winding radius, as shown in FIGS. 4 and 5. At the smallest winding radius $R_{min}$ (FIG. 4), the gap 8 has the smallest height $h_{min}$ in the center and the greatest height $h_{max}$ at the longitudinal edges of the support plate 5. In contrast, at the greatest winding radius $R_{max}$ (FIG. 5), the gap 8 has the greatest height $h_{max}$ at the center and the smallest height $h_{min}$ at the edges of the support plate 5. The gap height or width therefore changes by the amount $h=h_{max}-h_{min}$, since in the embodiment of FIGS. 3 through 5, the support plate 5 cannot bend and is not supported at both longitudinal edges.

Figure 6:
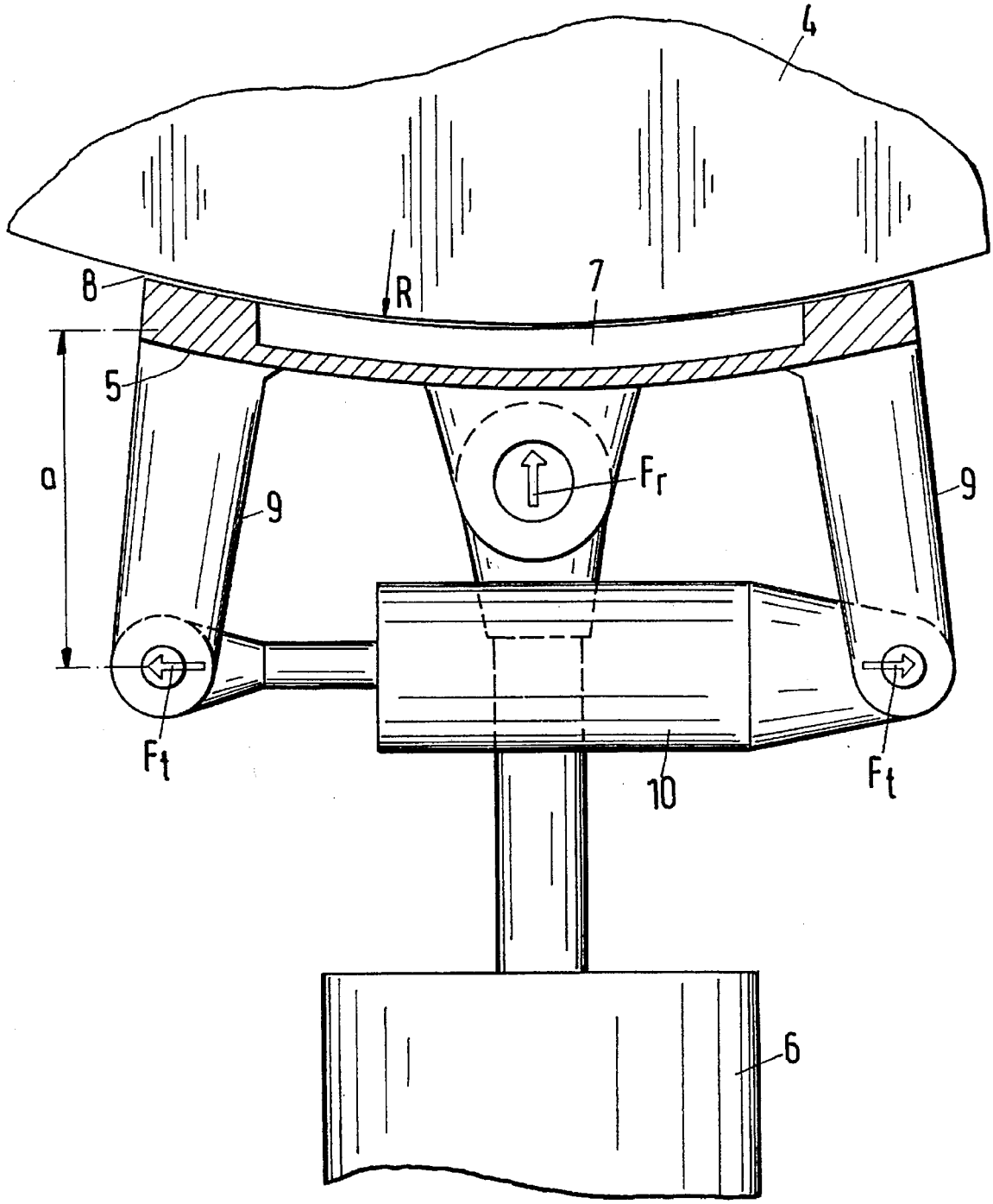
FIG. 6 is a sectional view of an alternate winding device according to the present invention.

It is however possible, both in the case of the support plate 5 of FIG. 2 as well as with the two support plates 5 of FIG. 3, to provide a modification as shown in FIG. 6, in which one or more support plates 5 or each support plate 5 has a downwardly protruding projection 9 attached on the under side of each support plate 5 on or near each plate's axial longitudinal edges. A servomotor 10 is secured in an articulated manner between the ends of the projections 9 and by means of which there can be exerted on each of the ends of the projections 9 a tangential force $F_t$ which causes a bending of the support plate 5 such that the radius of curvature of the support plate's upper side corresponds to the current radius R of the winding 4 on the winding roller 2. In addition, just one servomotor 6 can be provided for the single support plate 5 or for each support plate 5, the radial force $F_r$ of which acts upon the center of the support plate 5. As a result of the tangential force $F_t$ of the linear servomotor 10, a bending moment $M=F_t \times a$, where "a" is the lever arm or approximately the radial length of the projections 9, is exerted upon the support plate 5. The bending moment is automatically adjusted to be approximately inversely proportional to the winding radius R and brings about an arc-shaped bending of the support plate 5. In this way, it is possible to adjust the gap 8 concentrically to the axis of the winding roller 2 at all winding radii R, and thus to achieve a substantial reduction in the average gap height, the advantage of which is that the air consumption is minimized.

In addition, with the winding device of FIG. 6, there is a clear separation between the control of the support force and the control of the gap form, wherein the winding radius R is the reference variable input for both of the closed loop or feedback controls for controlling the forces $F_t$ and $F_r$.

While the embodiment of the invention shown and described is fully capable of achieving the results desired, it is to be understood that this embodiment has been shown and described for purposes of illustration only and not for purposes of limitation. Other variations in the form and details that occur to those skilled in the art and which are within the spirit and scope of the invention are not specifically addressed. Therefore, the invention is limited only by the appended claims.

What is claimed is:

1. A winding device for supporting a winding roller (2) for web material (1) that is wound as a winding (4) on the winding roller (2), said winding having an outer contour, said winding device comprising:

a supporting arrangement (5, 6) which supports the winding roller (2) from underneath in opposition to a deflection of the winding roller (2) and which creates a compressed air cushion of compressed air between said supporting arrangement (5, 6) and the winding roller (2), said supporting arrangement (5, 6) comprising:

at least one support plate (5) with an upper side which is substantially matched to the contour of an under side of the winding (4), said at least one support plate (5) is automatically moveable radially in response to the changing winding diameter of the winding (4) on the winding roller (2), thereby adapting said at least one support plate (5) to the winding (4) contour;

at least one compressed air outlet opening (7) in said at least one support plate (5); and a gap (8) between the winding roller (2) and said at least one support plate (5) through which said compressed air exits.

2. The winding device of claim 1, wherein said at least one support plate (5) is flexible.

3. The winding device of claim 2, wherein said at least one support plate (5) is supported on said under side adjacent axial longitudinal edges of said at least one support plate (5)

by means of a servomotor (6) which is pivotably secured to said axial longitudinal edges and by means of which a force ($F_r$) is exerted on each end of said at least one support plate (5), an axial movement of said servomotor (6) causes a corresponding height adjustment of said at least one support plate (5), a deflection of said at least one support plate (5) results wherein the radius of curvature of said upper side corresponds to the current radius (R) of the winding (4) on the winding roller (2).

4. The winding device of claim 1, wherein said at least one support plate (5) is pivotably supported on said under side of said at least one support plate (5) by means of a servomotor (6) which is secured to said at least one support plate (5), a force ($F_r$) is exerted by said servomotor on said at least one support plate, an axial movement of said servomotor (6) causes a corresponding height adjustment of said at least one support plate (5), a positioning of said at least one support plate (5) is assured wherein the radius of curvature of said upper side of said at least one support plate (5) corresponds to the current radius (R) of the winding (4) on the winding roller (2).

5. The winding device of claim 1, wherein said at least one support plate (5) comprises a projection (9) along the axial longitudinal edges, which protrudes downward, having a servomotor (10) pivotably secured to said projection by means of which there can be exerted a force ($F_r$) on the ends of said at least one support plate (5) which causes a bending of said at least one support plate (5) such that the radius of curvature of said upper side corresponds to the current radius (R) of the winding (4) on the winding roller (2).

6. The winding device of claim 1, wherein said at least one support plate extends substantially axially with respect to said winding roller.

* * * * *